US005969278A

United States Patent [19]

Tsai

[11] Patent Number: 5,969,278

[45] Date of Patent: Oct. 19, 1999

[54] MUSIC PRODUCING BEVERAGE CUP WITH ELECTRONIC SWITCH IN A STRAW

[76] Inventor: Yu-Chu Tsai, No. 19 Lane 437, Hai-Huan Street, Tainan, Taiwan

[21] Appl. No.: 09/075,399

[22] Filed: May 11, 1998

[51] Int. Cl.[6] ..... G10F 1/06

[52] U.S. Cl. ..... 84/94.2; 84/600; 449/176; 449/297

[58] Field of Search ..... 84/94.1, 94.2, 84/95.1, 95.2, 600, 644; 446/175, 176, 297

[56] References Cited

U.S. PATENT DOCUMENTS

| | | | |
|---|---|---|---|
| 2,252,289 | 8/1941 | Kind et al. | 84/94 |
| 3,020,538 | 2/1962 | Swanson, Jr. et al. | 340/235 |
| 3,122,959 | 3/1964 | Barr | 84/94 |
| 3,668,365 | 6/1972 | Norin et al. | 219/149 |
| 3,906,415 | 9/1975 | Baker | 335/47 |
| 4,121,835 | 10/1978 | Garabedian | 274/1 R |
| 4,631,715 | 12/1986 | Hoover | 369/68 |
| 4,813,368 | 3/1989 | Hutter, III et al. | 116/67 R |
| 5,344,034 | 9/1994 | Eagan | 215/11.1 |

OTHER PUBLICATIONS

"lead Poisoning and Your Children," Environmental Protection Agency , pamphlet # 800–B–92–0002, Sep. 1992.

*Primary Examiner*—Robert E. Nappi
*Assistant Examiner*—Wesley Scott Ashton

[57] ABSTRACT

A beverage cup includes a cup body, a base located on the cup body and having a circuit board and a speaker, and a cap closing on the base. The cap has a short straw portion protruding out and connected to an upper connect post aligned with a lower connect post in the base and connected to a long tube in the cup body. The circuit board is connected to two lead wires extending into the upper connect post and having their ends that are spaced apart a little in the passageway of the upper connect post. The two ends are connected electrically and power the circuit board to operate the speaker to when drink in the cup body is sucked out through the short straw portion.

1 Claim, 3 Drawing Sheets

MUSIC PRODUCING BEVERAGE CUP WITH ELECTRONIC SWITCH IN A STRAW

BACKGROUND OF THE INVENTION

This invention relates to a music-producing beverage cup, and particularly to one plays music when drink in the sucking cup is being sucked through a passageway in a connect post for connecting together portions of a straw with two lead wires protruding into the passageway and connected electrically to power a circuit board and a speaker to produce music while a user sucks the drink in the cup.

Conventional beverage cups of the type including a built-in straw, and which store a drink to be sucked out by a user, are convenient to be carried about to provide drinks when needed, but serve no other purposes. Although some of them may be made to have decorative shapes or designs, they can no longer attract consumers' interest.

SUMMARY OF THE INVENTION

This invention has been devised to offer a beverage cup of the above-type with music to attract consumers' curiosity.

The main feature of the invention is two lead wires having spaced-apart stripped ends which extend with a small gap into a passageway in a straw connect post, so that they will be connected electrically to power a circuit board and a speaker for producing music when drink stored in the sucking cup is being sucked out by a user.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
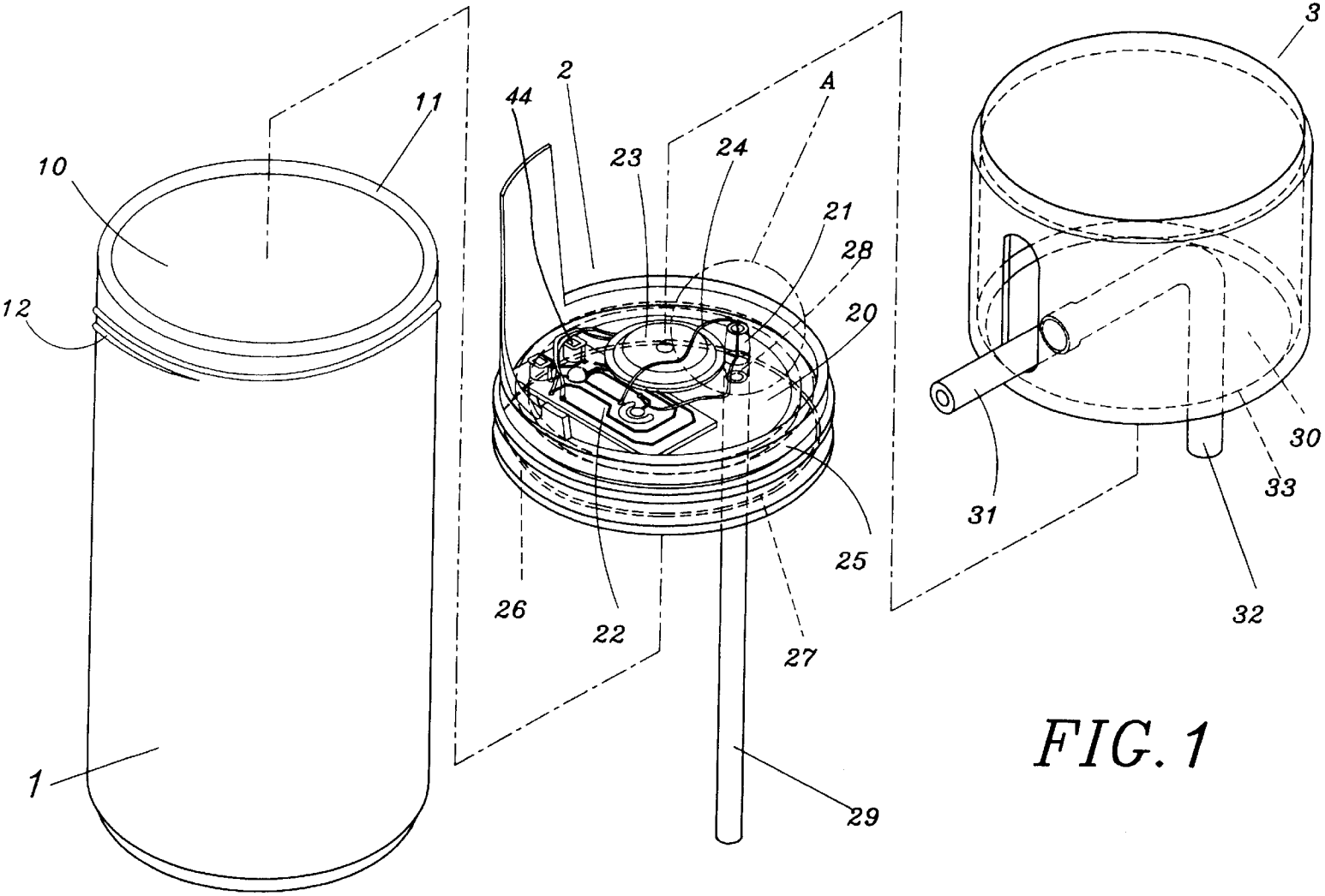
FIG. 1 is an exploded perspective view of a sucking cup with music in the present invention.
Figure 2:
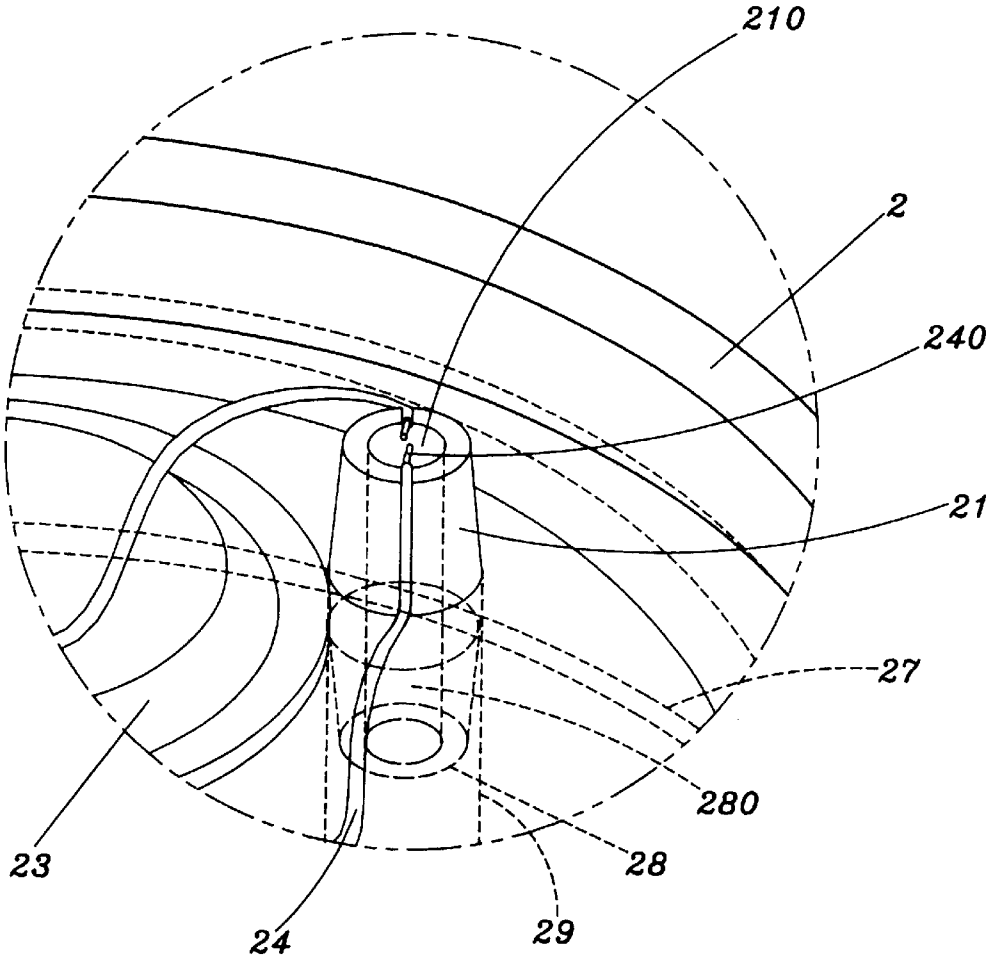
FIG. 2 is an enlarged view of the part marked A in FIG. 1.

A preferred embodiment of a sucking cup with music according to the present invention, as shown in FIGS. 1 and 2, includes a cylindrical cup body 1, a base 2 located on the cup body 1, and a cap 3 combined together.

The cylindrical cup body 1 is provided with a hollow center 10, an upper circular edge 11 and male threads 12 formed in an outer surface under the circular edge 11.

The base 2 has a shallow upper recess 20 in an upper surface of the base 2, a cone-shaped upper connect post 21 located vertically in the recess 20 and having a center passageway 210, a lower connect post 28 located vertically under the bottom and having a center passageway 280 aligned to the passageway 210 of the upper connect post 21, and a rectangular circuit board 22 and a circular speaker 23 fixed on the bottom of the recess 20 and connected to each other by wires 44.

The circuit board 22 is electrically connected to the two lead wires 24, which extend into the passageway from two sides of the connect post 21 and have stripped ends 240 are spaced apart with a little gap in the passageway 210, as shown in FIG. 2.

An annular groove 25 is formed around an upper portion of a circumferential recessed wall 26 of the base 2, and female threads 27 are formed in an inner side of the wall 26 to engage with the male threads 12 of the cup body 1 when the cup body 1 is assembled with the base 2. Further, a lower connect post 28 is vertically provided in a lower recess under the bottom in line with the upper connect post 21, having a passageway 280 communicating with the passageway 210 of the upper connect post 21. Then a long tube 29 is connected to the lower connect post 28, extending into the hollow 10 of the cap body 1.

The cap 3 is removably assembled with the base 2, having a hollow interior 30 opening to a lower end, a short straw portion 31 laterally passing out through the wall of the cap 3 and connected to a L-shaped soft tube 32 extending downward in the interior 30. A round annular projection 33 is formed around the opening of the cap 3 to engage the annular groove 25 of the base 2 when the cap 3 is closed on the base 2 and the cup body 1.

Figure 3:
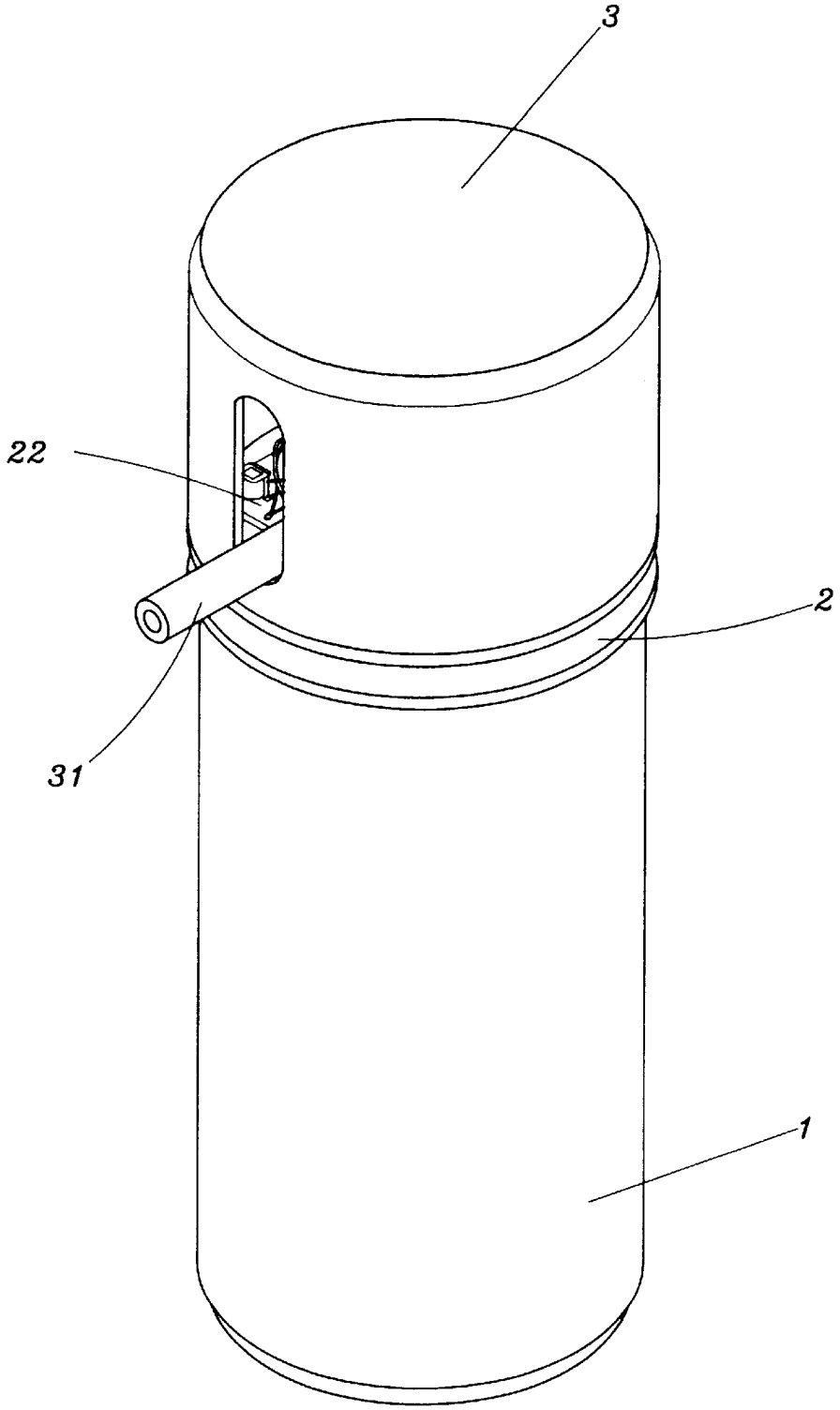
FIG. 3 is an perspective view of the sucking cup in the present invention.

In assembling, referring to FIG. 3, firstly, the soft tube 32 is fitted around the upper post 21, and next, the round annular projection 33 of the cap 3 is engaged with the annular groove 25 of the base so that the cap 3 is assembled with the base 2. Then the sucking tube 29 is placed in the center hollow 10 of the cup body 1, and the circumferential recessed wall 26 is engaged with the circular edge 11 of the cup body 1. Lastly, the base 2 is screwed into the cup body 1, with the female threads 27 engaging the male threads 12.

In using this sucking cup with music, the base 2 is screwed counterclockwise and removed from the cup body 1. Then drink, such as tea, water, etc., is poured in the hollow 10, and the base 2 is screwed clockwise again into the cup body 1. If a user wants to drink the drink stored therein, the user sucks it through the short straw portion 31, with the drink therein passing through the straw portion 29, and the passageways 210, 280 of the upper and the lower connect posts 21, 28. Then the two stripped ends 240 of the two wires 24 located in the passageway 210 are electrically connected by means of the liquid drink passing upward through the upper connect post 21, with the circuit board 22 and the speaker 23 powered to operate to give out music for the user to enjoy. In case the user stops sucking, the electricity flowing through the naked ends 240 of the lead wires 24 are cut off, with no liquid drink passing through them.

As can be understood from the aforesaid description, the sucking cup with music in the invention has the following advantages:

1. Music can be produced by the circuit board and the speaker while a user is drinking the drink stored in the cup body, functioning as a source of entertainment and interest.

2. It has simple components to be assembled easily.

While the preferred embodiment of the invention has been described above, it will be recognized and understood that various modifications may be made therein and the appended claims are intended to cover all such modifications which may fall within the spirit and scope of the invention.

What is claimed is:

1. A musical beverage cup comprising a cup body, a base combined with said cup body, and a cap arranged to fitted on said base;

said base having an upper connect post and a lower connect post respectively provided on and under a bottom of said base, said upper and said lower post having respective passageways, said passageways being in communication with each other, a long tube connected to said lower post and extending in a hollow interior of said cup body, a short straw portion connected to said upper connect post and projecting laterally out of said cup for sucking, and a circuit board and a speaker fixed on the bottom of said base and electrically connected to each other, wherein said circuit board is electrically connected to two lead wires, which extend into said passageway from two sides of said upper connect post, said two wires having their two ends stripped and spaced apart with a small gap between the ends so that when a user sucks on said short straw portion, liquid drink stored in said cup body is sucked up to pass through said upper connect post into said short straw portion, causing said two ends of said two lead wires to be electrically connected to power said circuit board, said circuit board then operating said speaker to play music while a user is sucking the drink.

* * * * *